United States Patent [19]

Garnier

[11] Patent Number: 5,055,853

[45] Date of Patent: Oct. 8, 1991

[54] MAGNETIC FRILL GENERATOR

[76] Inventor: Robert C. Garnier, S65 W24940 Robyn Rd., Waukesha, Wis. 53186

[21] Appl. No.: 252,566

[22] Filed: Oct. 3, 1988

[51] Int. Cl.[5] ..... H01Q 13/18

[52] U.S. Cl. ..... 343/769; 343/746

[58] Field of Search ..... 343/789, 769, 746, 768, 343/856, 859–861

[56] References Cited

U.S. PATENT DOCUMENTS

| | | | |
|---|---|---|---|
| 2,508,085 | 5/1950 | Alford | 343/769 |
| 2,611,865 | 9/1952 | Alford | 343/769 |
| 2,644,090 | 6/1953 | Dorne | 343/769 |
| 4,443,804 | 4/1984 | Smith | 343/769 |
| 4,509,209 | 4/1985 | Itoh et al. | 343/769 |
| 4,821,040 | 4/1989 | Johnson et al. | 343/769 |

*Primary Examiner*—Michael C. Wimer

[57] ABSTRACT

An electromagnetic field is produced by an oscillating magnetic frill that is generated at a slot gap in a resonating toroidal cavity. The magnetic frill's generating structure is physically small in relationship to its operating wavelength. Due to its small size relationship, the structure would be classified as a small antenna. The internal placement of inductance or capacitance allows the ability to raise or lower the resonant frequency of the structure. The structure's function can be changed by moving the placement of the frill generating gap. The structure can be made to radiate, partially radiate or completely nonradiate. The invention can function for example as a small antenna, a nonradiating probe or coil, or a resonant transformer.

9 Claims, 8 Drawing Sheets

MAGNETIC FRILL GENERATOR

BACKGROUND OF INVENTION

This invention relates to small radiating antennas, resonating coils or probes and resonant transformers. The invention is small in physical size in comparison to its present state of the art counterparts.

Electrically small antennas are those whose dimensions when measured from its input terminals do not exceed ⅛ of a wavelength to its end locations. These small antennas are used primarily at HF and lower frequencies on vehicles, spacecraft, aircraft and transportable transceivers. They generally have narrow bandwidths and unfavorable input impedance characteristics They generally utilize a ferrite core material for receiving and become larger in size when employed for the transmitter end of a communications link. The transmitter end becomes quite large when large power is required such as in the ELF band of operation. Efficiencies of the present state of the art antennas are low and have a value in the order of 1%.

In present art there appears a structure patented by Reggia & Jones (U.S. Pat. No. 4,051,480 issued on Sept. 27, 1977 titled Conformal Edge-Slot Radiators). Their dielectric loaded edge-slot radiator which is an integral part of another structure must have its exterior dimensions conform to the structure which attached to allow flush mounting on large cylindrical and conical bodies as shown in their drawing. The problem with their adjustable dimensions is that the resonant frequency of their antenna can not be readily changed to fit the mounting structure. Whatever structure that employs their antenna must use various ferrite loading configurations. The antenna cannot be readjusted after assembly The antenna utilizes printed circuit board material that cannot handle large transmit power levels (that is over 100 watts). When the antenna is attached to large cylindrical and conical bodies as shown in their drawing, their structure would not be considered as a small antenna by antenna standards in use today Their invention by their description needs the addition of a larger attached structure to function.

In the medical field the usage of resonant RF coils are being employed in such areas as Nuclear Magnetic Resonance. The problem with presently utilized coils is that in order to place the patient inside the coil, the coil's self resonance limits the upper operating frequency that can be used and partially radiates.

Transformers utilized in AC power, use a magnetic core material to provide a concentrated loop of magnetic flux. The magnetic flux passes thru loops of coils of different windings placed in its path to allow voltage and current to be changed or transformed into different values. All present AC power transformers, use a magnetic core that is nonresonant to function.

SUMMARY OF INVENTION

The antenna structure of the invention has a suitable source such as a coaxial BNC input feeding radio wave energy to an internal balun that connects to an internal resonating structure. The internal resonating cavity structure produces an internal resonating toroidal electromagnetic field that is in the Transverse Electromagnetic Mode that couples to a slot gap. The use of toroidal herein defines any encircling field The slot gap at its opening produces an oscillating toroidal magnetic frill external to the resonating cavity structure. The generated oscillating toroidal magnetic frill causes a radiating electromagnetic field to exist. Because the oscillating magnetic frill generates the electromagnetic field, the invention structure is physically small in relationship to its operating wavelength. The invention antenna structure would be classified as a small antenna.

By the uniqueness of the structural design of this invention, the radiating slot gap's location can be moved. The repositioning of the slot gap, will cause the function of the structure to change. By having the slot gap on the outside of the structure, the generated oscillating magnetic frill will cause an electromagnetic field that radiates. By having the slot gap located on the inside of a structure such as one in the shape of a donut, the generated magnetic frill's radiation field will cancel outside the central hole part of the structure. By having the slotted gap concentrated as a ring on the outside of the structure (it would appear as a cutoff end of a coaxial line), the generated magnetic frill's radiation field will partially cancel but will be capable of radiating to a nearby object. By having the location of the slot completely on the inside of the structure with no openings to the outside, the generated magnetic frill's radiation field will be entirely enclosed inside the structure and the structure can be used as a resonant transformer with voltage, current or impedance taps.

By changing the shape of the oscillating magnetic frill, the electromagnetic radiation pattern can be altered to produce directivity or antenna gain. The shape of the oscillating magnetic frill can be changed in several ways. The slot gap's spacing can be varied around the structure. The slot gap's depth size can be varied around the structure. The structure's toroidal symmetry can be skewed off center in order to change the structure's internal electromagnetic field so that its strength varies around the slot gap. The varying of the field strength coming from the slot gap will cause the oscillating magnetic frill around the structure to have a varying field strength. The oscillating magnetic frill of varying field strength will provide a means of altering the electromagnetic directional pattern coming from the invented antenna structure.

BRIEF DESCRIPTION OF DRAWING

The drawing furnished herewith illustrates the best modes presently contemplated by the inventor for carrying out the subject invention.

DESCRIPTION OF ILLUSTRATED EMBODIMENTS

Figure 1:
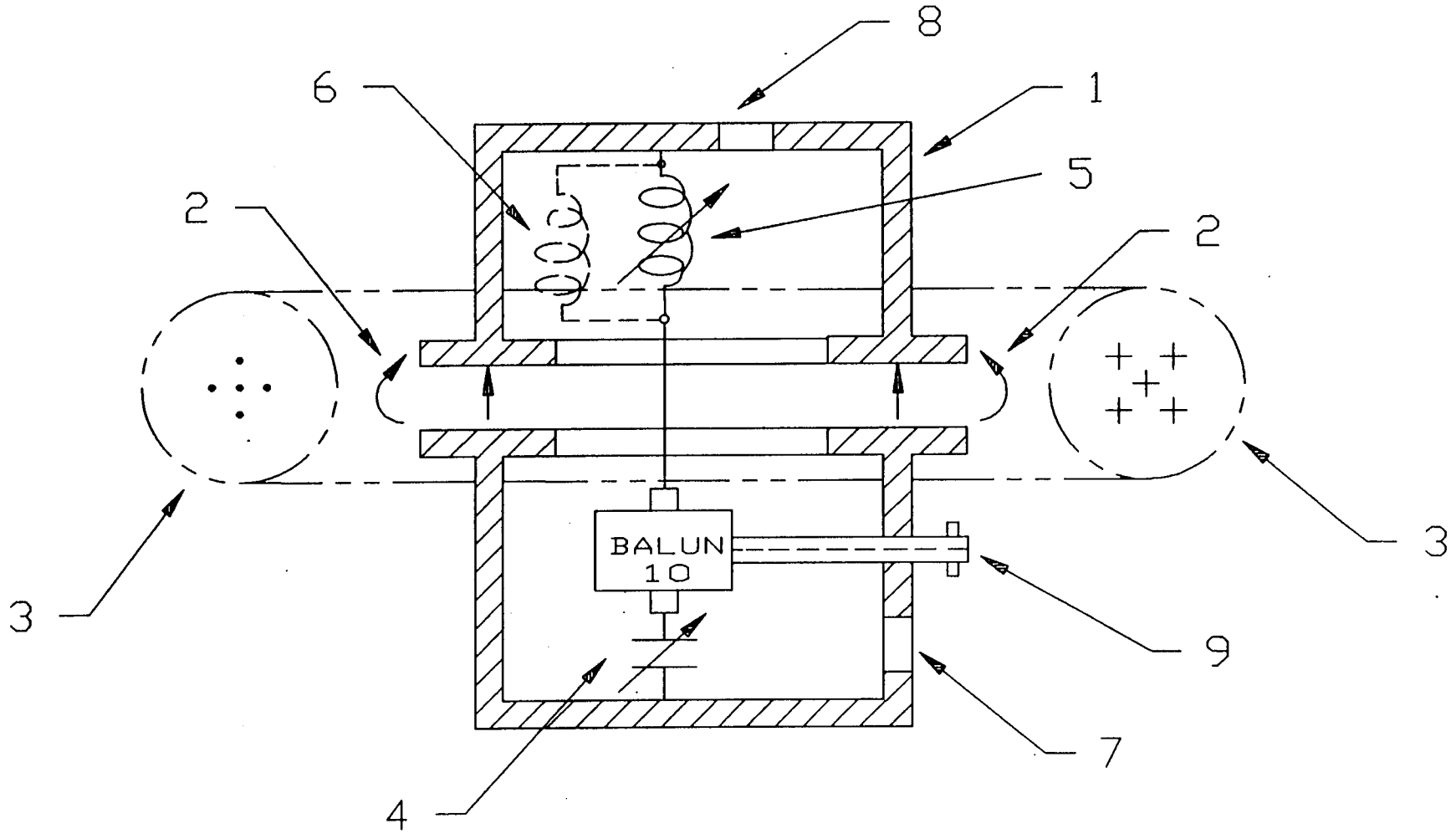
FIG. 1 illustrates a radiating antenna structure constructed in accordance with the present invention.

Referring to the drawing and particularly to FIG. 1, the antenna structure made of a conducting material 1 is a resonating toroidal cavity with a circular resonant slot gap 2. The resonant slot gap 2 generates an electric field at the gap of its circular opening that in turn produces a magnetic frill 3. The generated magnetic frill 3 in turn generates a radiating electromagnetic field that propagates away from the structure. The structure self resonates by the capacitance of the slot gap 2 and added series capacitance 4 and the inductance of the cavity structure and an added series inductance 5. The inductance is adjustable and is preferable to be significantly greater than that of the self inductance of the cavity to be the principle control of the resonant cavity oscillating frequency. Parallel capacitance can be added across the gap 2 to lower the resonant frequency of the structure. Parallel inductance 6 can be added across the internal inductance to raise the resonant frequency of the structure. The inductor 5 (FIG. 1) and the series connected variable capacitor 4 are chosen to raise or lower the self resonating frequency of the structure. Openings are provided in the side and top of the structure at 7 and 8 so that the inductance and capacitance can be varied. Energy is fed into the structure by means of a coaxial input 9 which is a nonbalanced line into a balun transformer 10 which provides a balanced output into the cavity.

Figure 2:
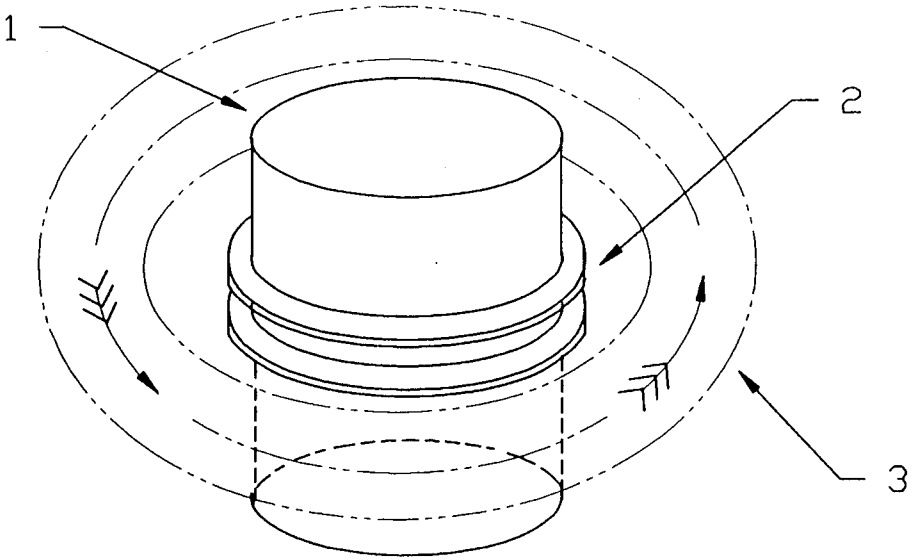
FIG. 2 shows the relationship of the radiating antenna gap, the generated magnetic frill and a dipole antenna.
Figure 2A:
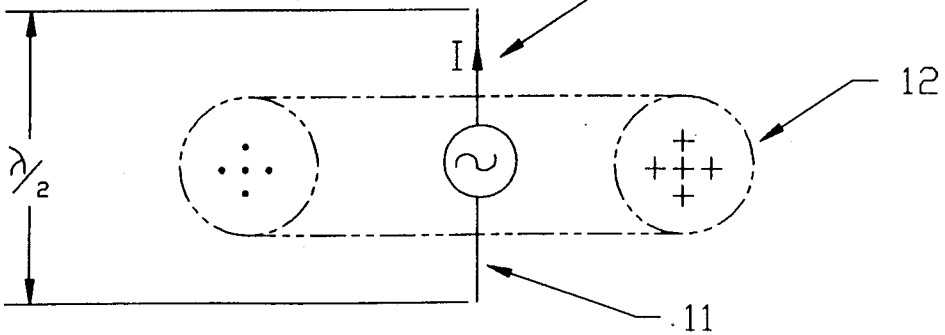
FIG. 2A is a schematic illustration cf a dipole antenna.

A dipole antenna as shown in FIG. 2A generates a magnetic frill 12 by means of a resonant current 13. The generated magnetic frill 12 thus is similar to that created by the structure in FIGS 1, 2, and 3. Relating to FIG. 2A, illustrates a typical dipole antenna whose size is one half wavelength from tip to tip. A similar cavity structure having a radiating slot must be at least one half wavelength in size. The present invention with an annular gap can be made with a wavelength as short as one eighth wavelength or less and will produce an electromagnetic field like a larger cavity structure with a radiating slot. For most practical applications, resonating cavity structures of wavelength proportions are not utilized below 1,000 MHz and the present invention is particularly and uniquely applicable below such range in providing a small compact antenna.

Figure 3:
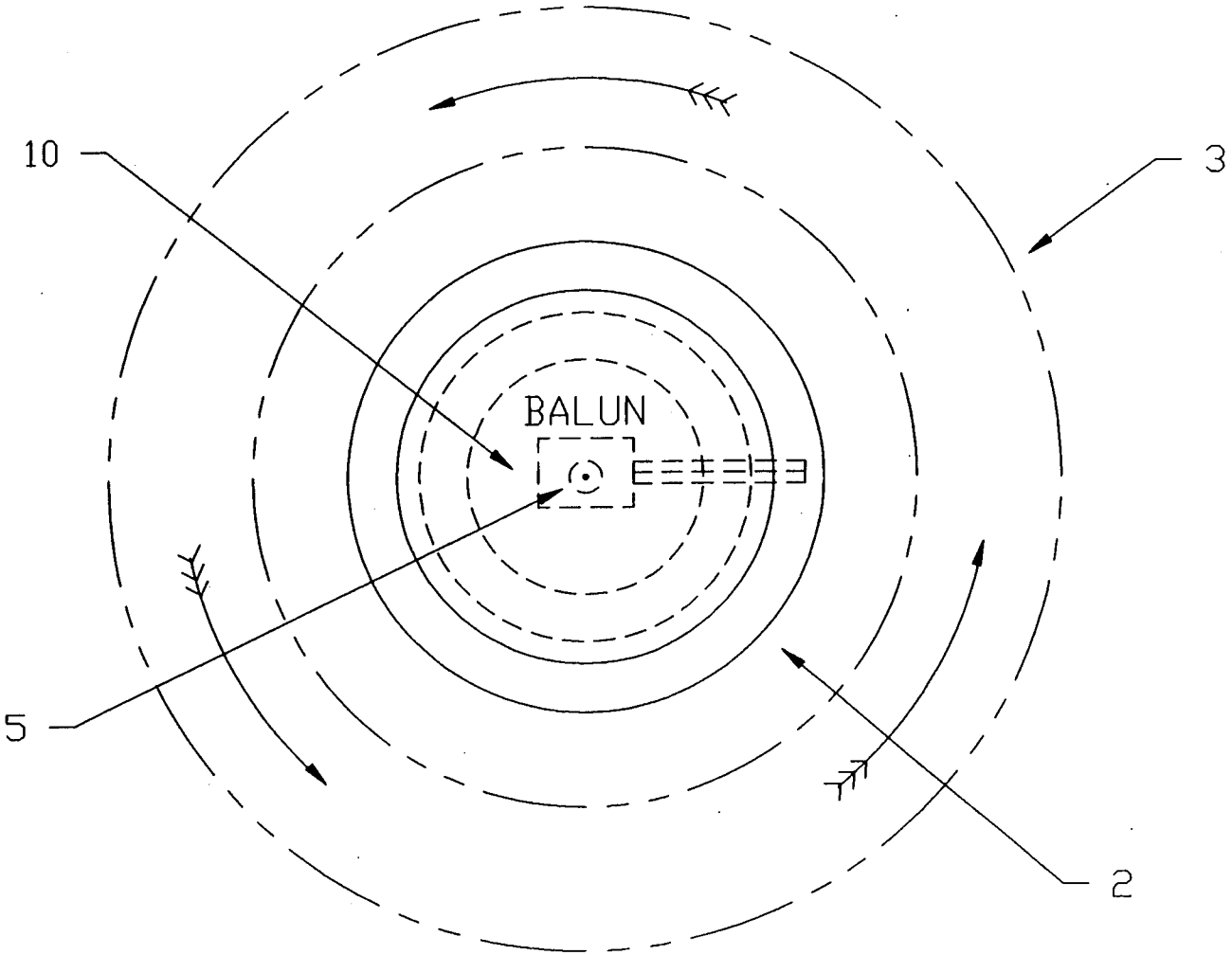
FIG. 3 illustrates a top view of FIG. 1 with the toroidal magnetic frill being generated around the gap.

Referring to FIG. 3, a top view of the structure is shown. The slot gap 2 is shown in FIGS. 1 and 3 having a uniform opening that in turn produces a symmetrical magnetic frill 3 The balun 10 is shown in the center of the resonating structure but can if desired be placed off center. The placement off center can be used as a means of varying the shape of the generated magnetic frill 3 and thus the structure's radiation pattern. The results of doing this is similar to that shown in the frill in FIG. 4.

Figure 4:
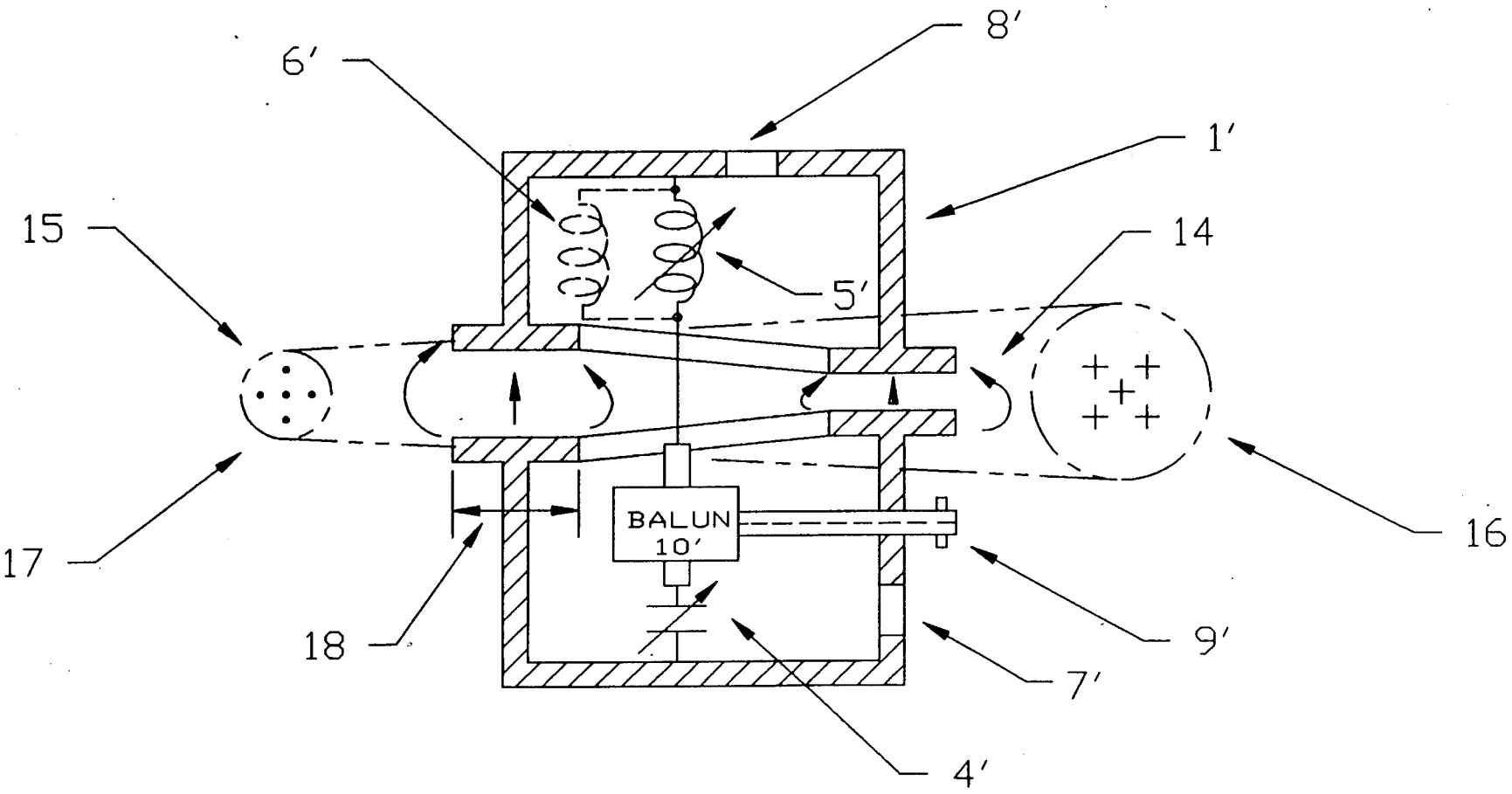
FIG. 4 is a structure similar to FIG. 1 illustrating a means of changing the shape and field strength of the magnetic frill.

Referring to FIG. 4, a modification of the structure in FIG. 1 is shown. FIG. 1 corresponding elements are identified with corresponding primed numbers in FIG. 4. By changing the distance of the gap 14 and 15 (shown as a gradual tapered change), the density of the electric field in the gap is varied. The variation of the electric field in the slot gap 14 and 15 will in turn cause a variation of the shape of the generated magnetic frill 16 and 17 around the structure. The varied generated magnetic frill 16 and 17 will thus cause the radiated electromagnetic field to have a directional pattern. Varying the depth 18 of the gap 14 and 15 instead of the distance will cause a similar modification to the magnetic frill.

Figure 5:
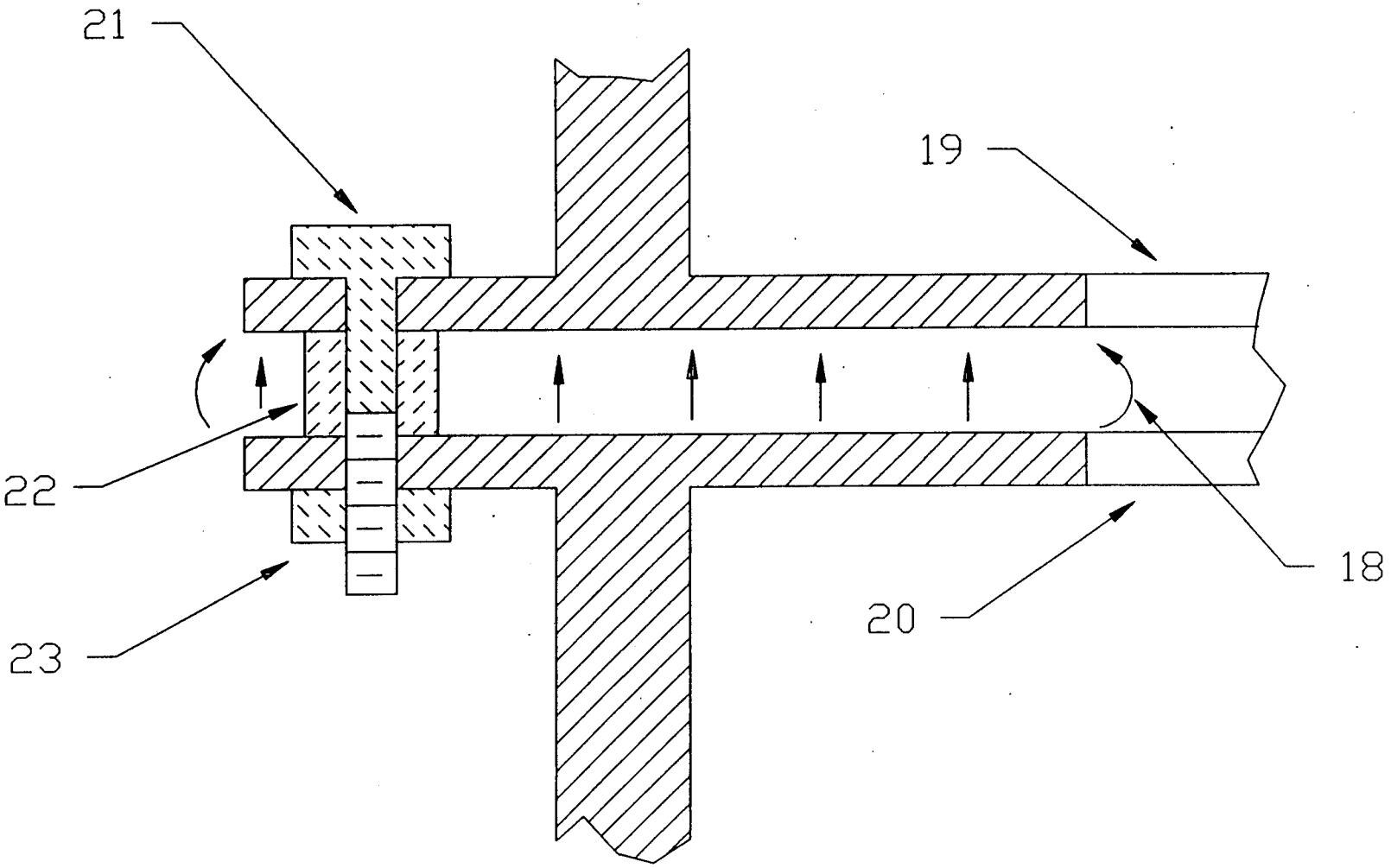
FIG. 5 is a sectional view of the gap showing one method of securing the top and bottom of the gap with a nylon bolt.

Referring to FIG. 5, a fragmentary sectional view of a gap 18 is shown. This sectional view shows one method of securing the top 19 and bottom 20 of the cavity structure forming the gap 18 with a low loss insulating nylon bolt 21. A nylon spacer 22 is used to maintain gap distance. A nut 23 secures the nylon bolt to the structure.

Figure 6:
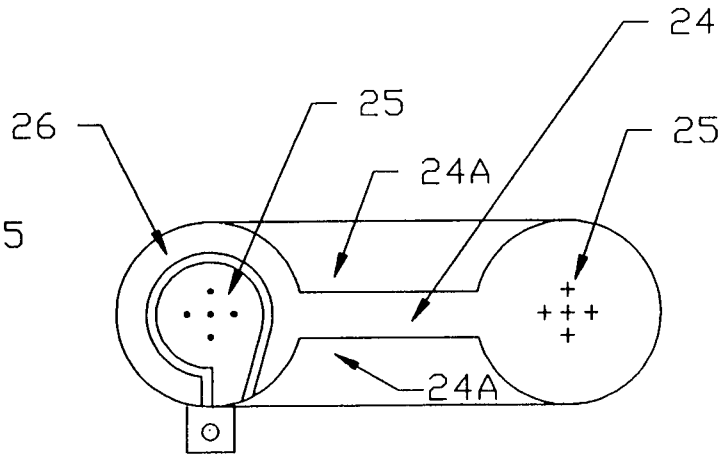
FIG. 6 is a side view of a structure similar to FIG. 1 illustrating a nonradiating gap.
Figure 7:
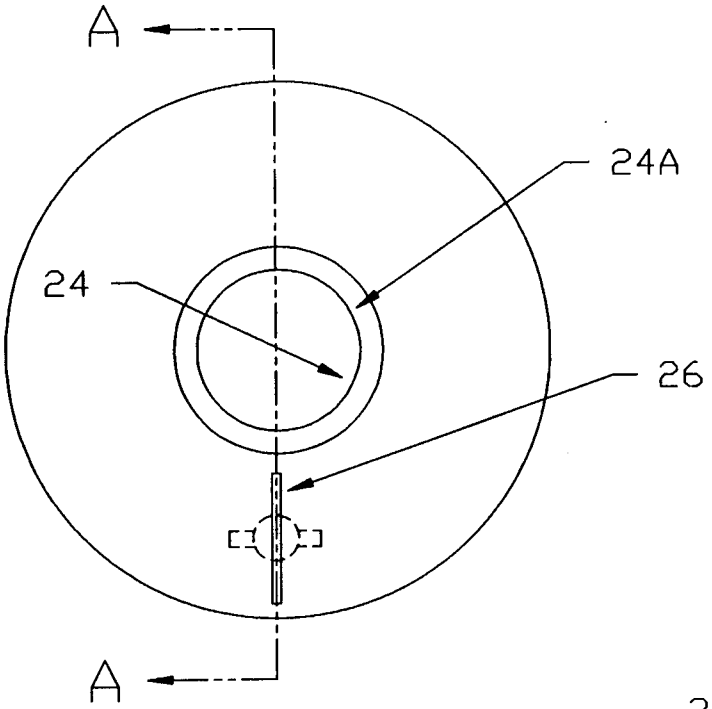
FIG. 7 is a top view of a structure similar to FIG. 1 illustrating a nonradiating gap.
Figure 8:
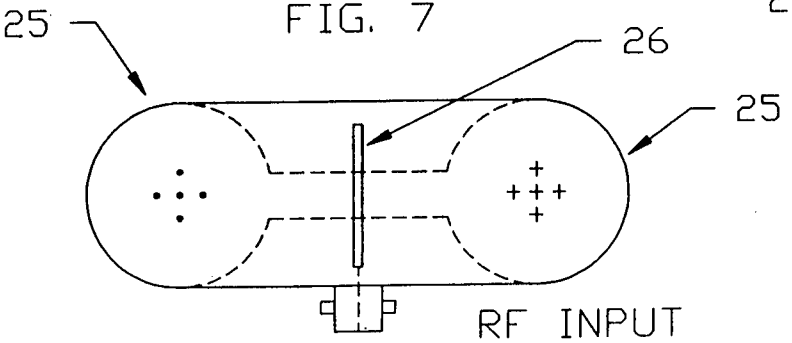
FIG. 8 is a front view of a structure similar to FIG. 1 illustrating a nonradiating gap.
Figure 9:
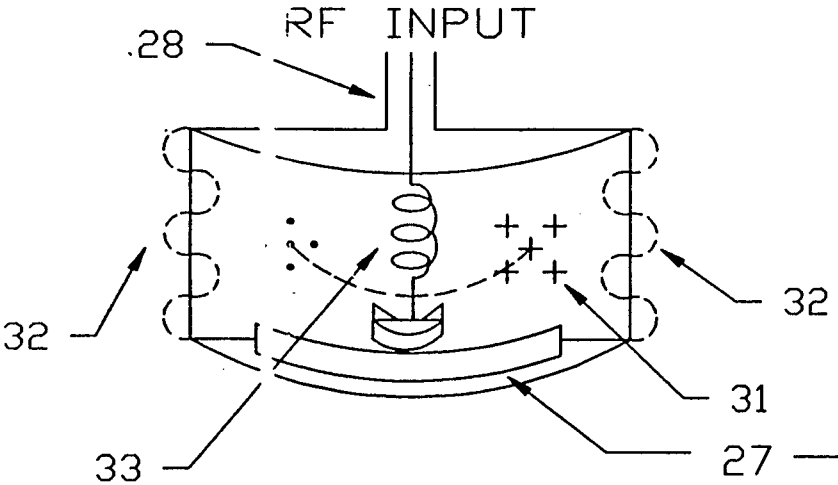
FIG. 9 is a one half pictorial view of a structure similar to FIG. 1 illustrating a partial radiating gap.
Figure 12:
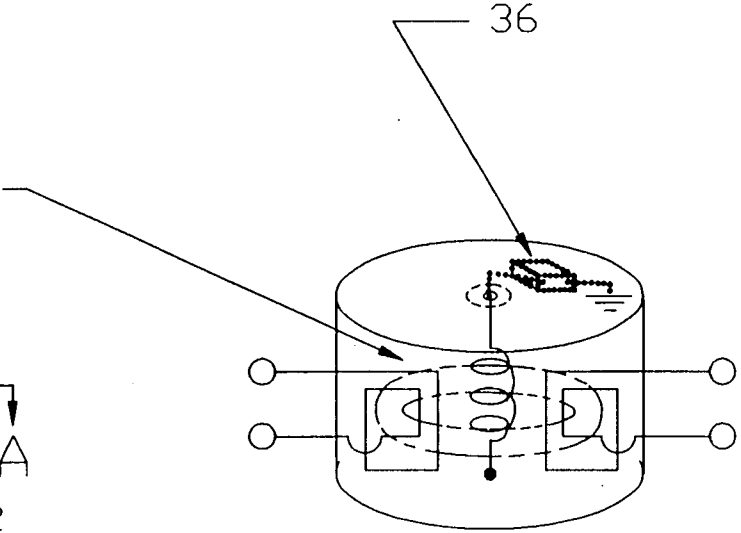
FIG. 12 is a pictorial view of a structure similar to FIG. 1 illustrating a nonradiating gap totally inclosed for use as a resonate transformer.

Referring to FIG. 6, 7 and 8, the cavity is shown as a doughnut shaped structure with the placement of the ga 24 on the inside of the structure. The gap 24 is created by spaced, outwardly projecting lips 24A and causes the generated magnetic frill not to radiate outside of the structure. The magnetic portion of the Transverse Electromagnetic field 25 inside the structure, as is in the other three structures FIG. 1, FIG. 9 and FIG. 12, is in the form of a toroid. The inside loop 26 of one or more turns is to couple the inside electromagnetic energy to an external energy source. The loop coil 26 can be replaced with the balun arrangement 10 as shown in FIG. 1 or the direct coaxial connection 28 as shown in FIG. 9.

Figure 10:
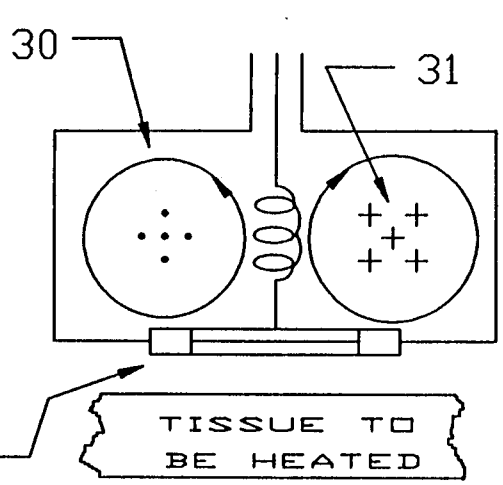
FIG. 10 is a side view of a structure similar to FIG. 1 illustrating a partial radiating gap.
Figure 11:
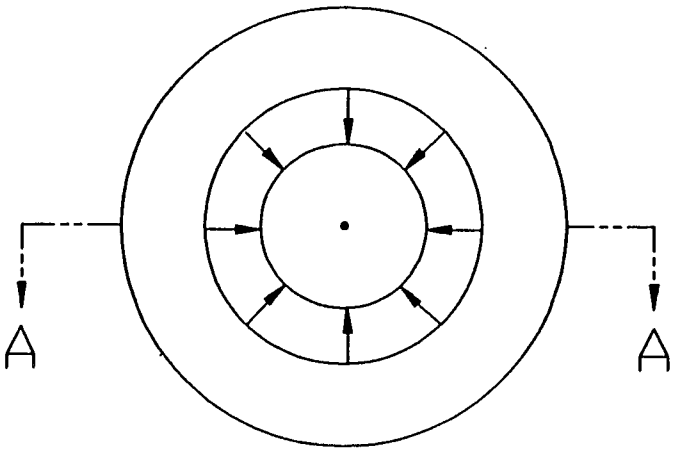
FIG. 11 is a bottom view of a structure similar to FIG. 1 illustrating a partial radiating gap.

Referring to FIG. 9, 10, and 11, the placement of the slot gap 27 in the bottom wall as shown concentrated will cause the radiating field to only effect nearby objects such as heating tissue 29 or plastic. The magnetic field inside the structure, as is in the other three structures FIG. 1, FIG. 6 and FIG. 12, is a Transverse Electromagnetic field in the form of a toroid that has an electric field 30 and a magnetic field component 31. By corrugating the wall 32 as shown in phantom in FIG. 9, the self inductance of the structure can be changed. This provides a result similar to using the separate inductor 5 of FIG. 1 or of inductor 33 in FIG. 9.

Figure 14:
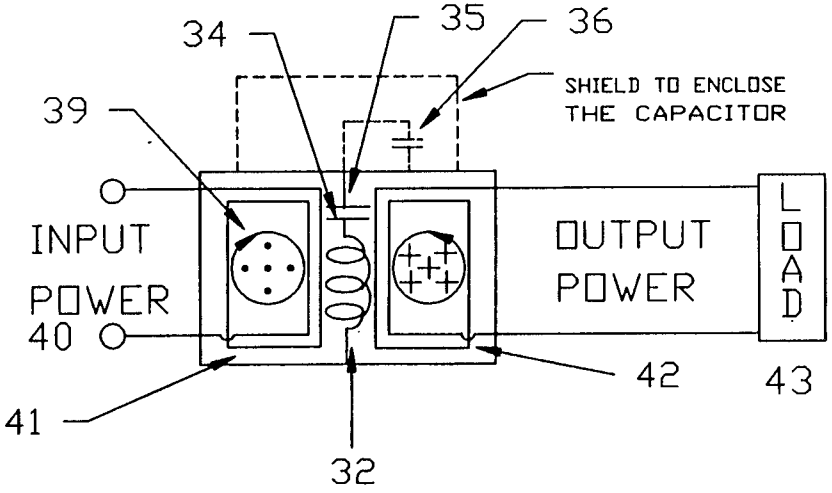
FIG. 14 is a side view of a structure similar to FIG. 1 illustrating a nonradiating gap totally inclosed for use as a resonate transformer.
Figure 13:
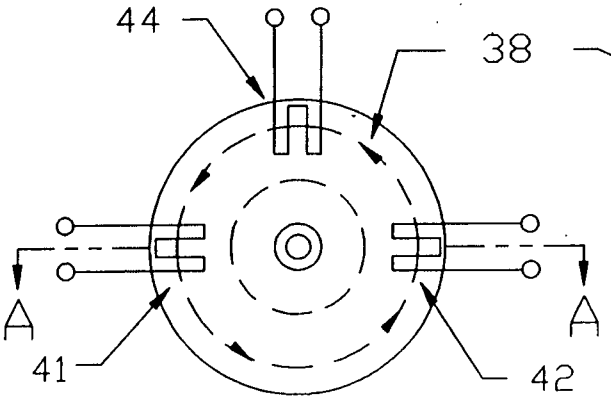
FIG. 13 is a bottom view of a structure similar to FIG. 1 illustrating a nonradiating gap totally inclosed for use as a resonate transformer.

Referring to FIG. 12, 13, and 14 the placement of the gap 34 on the inside of the structure is done by means of a capacitor 35 so that any generated magnetic frill will occur inside the capacitance 35. The capacitor 35 can be placed inside the structure in series with the inductor 37 so that no opening will be present at all on the outside of the structure. The magnetic field inside the structure, as is in the other three structures FIG. 1, FIG. 6 and FIG. 9, is a Transverse Electromagnetic field in the form of a toroid that has an electric field 39 and a magnetic field component 38. The input power 40 enters the structure by a wire coil 41 and exits by means of a second coil 42 that feeds some electrical load 43. A third coil 44 or more wire coils can be placed inside the structure in order to tap into the resonating field and provide different voltage, current and impedance settings. The phantom placement of an AC capacitor 36 shows one method of placing the reactive components so that they could be easier to repair and replace.

Thus, the present invention provides a relatively direct and simple means of generating a resonate toroidal or annular Transverse Electromagnetic field that by various placement of the capacitance slot gap in the structure can be made to radiate, partially radiate or completely not radiate an electromagnetic field. The invention can function for example as an small antenna, a nonradiating probe or coil or as a resonant transformer.

I claim:

1. A structure for generating an external continuously encircling transverse electromagnetic field, comprising a tubular cavity wall structure defining a cavity, said wall structure being electrically conductive, an energizing device mounted in the cavity for supplying an internal electromagnetic field to said cavity, a continuous uninterrupted annular gap in the cavity wall structure and constituting the only opening into said cavity, said wall structure creating a self inductance, said energizing device including a separate inductor connected between said cavity wall structure and a feed input, said continuous uninterrupted gap located to function with said inductor and defining a single capacitor functioning conjointly with said inductor and said self inductance of said cavity wall structure to establish a single resonating assembly having a resonant frequency controlled by the self inductance of said wall structure and said separate inductor and uninterrupted gap capacitance and whereby the field in said gap resulting from the internal electromagnetic field creates an external oscillating magnetic frill.

2. The structure in claim 1 wherein said wall structure being less than about one eighth wavelength in physical size in the plane of the annular gap.

3. The structure in claim 1 wherein a capacitance load is connected between said single capacitor of said uninterrupted gap, whereby said resonating assembly having a frequency related to the capacitance combination of said single capacitor and said added capacitance load.

4. The structure in claim 1 wherein said cavity wall structure has an outer sidewall and a topwall and a bottom wall, said annular gap being located in said outer sidewall of the structure, the generated magnetic frill creates an electromagnetic field which radiates.

5. The structure in claim 1 wherein said tubular cavity wall structure defines a continuous uninterrupted annular shaped member having an outer sidewall and having an internal sidewall defining a central hole, said uninterrupted annular gap is located in the internal sidewall of the structure, the generated magnetic frill's radiation field reduces rapidly outside the central hole of the structure.

6. The structure in claim 1 wherein said cavity wall structure has a substantially flat outer end wall, said uninterrupted annular gap is located in said flat outer end wall, said energizing device is connected to said flat wall within said gap, the generated magnetic frill's radiation field is thereby partially cancelled but will be capable of radiating to a near field object.

7. The structure of claim 1 wherein said gap has a width substantially smaller in at least one portion of the gap than other portions of the gap and the magnitude of said frill varies around the annular gap.

8. The structure of claim 7 wherein a larger gap spacing and a smaller gap spacing are formed in the annular gap opening and the larger and smaller gap spacings provide radiation pattern adjustments by modifying the magnetic frill's field.

9. The structure of claim 8 wherein the length of said gap spacing changes progressively about the circumference of the annular gap.

* * * * *